United States Patent [19]

Vitt

[11] 3,978,549

[45] Sept. 7, 1976

[54] CONCEALED FURNITURE HINGE

[75] Inventor: Theodor Vitt, Porz-Eil, Germany

[73] Assignee: Prameta Prazisionsmetall- und Kunststofferzeugnisse G. Baumann & Co., Cologne, Germany

[22] Filed: Dec. 4, 1974

[21] Appl. No.: 529,376

[30] Foreign Application Priority Data

Dec. 12, 1973 Germany ..... 2361748
Feb. 11, 1974 Germany ..... 2406439

[52] U.S. Cl. ..... 16/129; 16/164
[51] Int. Cl.[2] ..... E05D 3/06
[58] Field of Search ..... 16/179, 178, 164, 166, 16/129, 130, 131, 132, 133, 163, 165

[56] References Cited

UNITED STATES PATENTS

| | | | |
|---|---|---|---|
| 3,541,633 | 11/1970 | Heinze | 16/164 |
| 3,562,853 | 2/1971 | Heinze | 16/164 |
| 3,590,420 | 7/1971 | Salice | 16/164 |
| 3,605,173 | 9/1971 | Lautenschlager, Jr. | 16/163 |
| 3,863,292 | 2/1975 | Grunert et al. | 16/164 |

FOREIGN PATENTS OR APPLICATIONS

| | | | |
|---|---|---|---|
| 712,610 | 9/1966 | Italy | 16/164 |

*Primary Examiner*—Andrew V. Kundrat
*Attorney, Agent, or Firm*—Diller, Brown, Ramik & Wight

[57] ABSTRACT

This disclosure relates to a concealed furniture hinge having a pair of links, one of which is formed as a pair of tandem link arms articulately connected to each other and having remote ends connected to respective ones of a pair of hinge elements, another link sandwiched between the first mentioned link arms and being pivoted immediately thereto as well as having opposite ends respectively pivotally and slidably connected to the hinge elements whereby when connected to an associated frame and door the hinge is concealed in the closed position of the door while in the open position the door is not only swung through approximately 90° but is also moved away from its associated frame.

18 Claims, 11 Drawing Figures

CONCEALED FURNITURE HINGE

Convention concealed hinges are well known and typical of these are scissor-like designs which are generally pivoted at one end to a frame and slidably mounted in an opposite end to a door or vice-versa. This structure requires a relatively long guide track to achieve optimum sliding motion which introduces inconveniences at the time of mounting, particularly when mounting one of the pair of hinge elements upon the associated door. In addition, doors so mounted can be swung only through 90° or slightly more.

Other concealed hinges are known in which the part of the hinge which is secured to the frame is formed as a pedestal for a striker which is guided longitudinally in the latter and which is articulately or pivotally connected to the door, leaf or wing. In such arrangements the hinge parts are additionally connected by a linkage composed of several links which positively permit swinging movement of the door in what might be best termed a combined turning and pushing movement. However, such hinges frequently cannot accommodate relatively heavy doors because the pivots between the links cannot take excessive loads or bending moments.

In keeping with the foregoing, it is a primary object of this invention to provide a novel concealed hinge, particularly for furniture, which includes a plurality of links so interconnected to permit a door or leaf to be swung as much as 180° and to accommodate relatively heavy doors while at the same time providing ease of mounting and adjustment to assure, in the case of the latter, that the door and frame are flush both in the closed and opened relative positions thereof.

The novel hinge of this invention includes a pair of hinge elements, a first link having opposite ends, first means for pivotally connecting a first end of the first link to one of the hinge elements and means for slidably connecting a second end of the first link to the other of the hinge elements, a second link having opposite ends with second pivot means for pivotally connecting a first end of the second link to the one hinge element and third pivot means for pivotally connecting a second end of the second link to the other of the hinge elements, the second link having first and second arms, means articulately connecting the second link arms to each other, and fourth pivot means between the articulate connecting means and the third pivot means for pivotally connecting one of the link arms to the first link at a position between the first pivot means and the slidable connecting means whereby optimum opening of the door can be achieved while at the same time relatively heavy doors can be supported with little or no sag.

A further object of this invention is to provide a novel hinge of the type heretofore described wherein the articulate connecting means is an elongated slot and pin connection between the first and second arms and the slidable connecting means is an elongated slot and pin connection between the first link second end and the other hinge element.

Yet another object of this invention is to provide a novel hinge of the type heretofore described including means for adjusting the position of the slidable connecting means relative to the other hinge element to adjust the position of the door relative to the frame and maintain the latter elements as flush as possible.

Still another object of this invention is to provide a novel hinge in which one of the hinge elements is connected to a frame and the slidable connecting means includes an elongated slot and pin connection of which the latter is generally parallel to the frame to obtain optimum opening of the door relative thereto.

A further object of this invention is to provide a novel hinge of the type aforesaid wherein one of the hinge elements includes a base plate adapted for mounting upon a frame and a carrier plate carried thereby, and means for relatively longitudinally adjusting the latter plates relative to each other to assure accurate alignment of an associated door and frame.

Still another object of this invention is to provide a hinge of the type aforesaid wherein the carrier and base plates are each of a U-shaped transverse cross-sectional configuration, and means are provided for locking these plates relative to each other and varying the inclination therebetween.

With the above and other objects in view that will hereinafter appear, the nature of the invention will be more clearly understood by reference to the following detailed description, the appended claimed subject matter, and the several views illustrated in the accompanying drawings.

IN THE DRAWINGS

Figure 1:
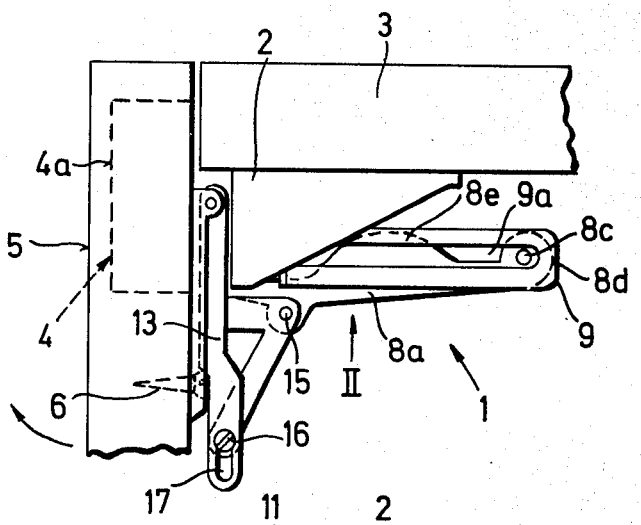
FIG. 1 is a fragmentary side elevational view of a novel hinge constructed in accordance with this invention, and illustrates hinge elements connected to a door and frame and interconnected to each other by links, pivots and slot and pin connections.

Reference is first made to FIGS. 1 through 5 of the drawings which illustrate a hinge generally designated by the reference numeral 1 which includes a pair of hinge elements 2, 4 which are secured respectively to a frame 3 and a door or leaf 5.

The hinge element 4 includes a generally cylindrical boss or projection 4*a* (FIGS. 1 and 5) which is received in a recess (unnumbered) of the door 5 and includes a peripheral flange 4*b* (FIG. 5) provided with apertures through which pass screws 6 threaded into the door 5.

A hinge element 2 is also provided with apertures (not shown) for securing the same to the frame 3 by screws (also not shown) in the same manner as the screws 6 attach the hinge element 4 to the door 5. The hinge element 2 also includes a pair of opposing flanges 2*a*, 2*a* (FIG. 4) which project into oppositely opening slots 9*e*, 9*e* (FIG. 4) of slidable mounting means 9 defined by a pair of parallel spaced bars 9*b*, 9*b* (FIG. 4) each having a slot 9*a* (FIG. 3) for receipt therein of a pivot pin 8*c*. The bars 9*b* are integrally formed with or connected to a base 9*f* (FIG. 3) which includes a pair of spaced projections 9*d* (FIGS. 3 and 4) having aligned apertures (unnumbered) which receive a pivot pin 12. The base 9*f* includes a slot 19 which opens upwardly as viewed in FIG. 4 for the passage therethrough of a screw 18 threaded into a threaded bore (not shown) of the base (unnumbered) of the hinge element 2. Another screw 20 passes through a slot 9*g* of the base 9*f* and is likewise threaded in a threaded bore (not shown) of the base (unnumbered) of the hinge element 2. The slots 19, 9*g* and the associated screws 18, 20 respectively, permit the means 9 to be bodily adjusted vertically i.e., upwardly or downwardly as viewed in FIG. 4 to raise or lower the door 5 relative to the frame 3. If, of course, the frame 3 were disposed in a horizontal plane the latter adjusting means would provide horizontal side-to-side relative adjustment of the door 5 and the frame 3.

The pin 8*c* is carried by an enlarged portion 8*d* (FIG. 3) of a first link 8 of the link mechanism 7. The link 8 includes a first arm portion 8*a*, a second arm portion 8*b* and a projection 8*e* therebetween which is of a height corresponding generally to the height of the bars 9*b*, 9*b* and when sandwiched therebetween (FIG. 1) cocking or tilting of the hinge elements is virtually precluded which in turn precludes the door 5 from sagging due to its own weight. A pivot pin 10 (FIGS. 3 and 5) pivotally connects the arm 8*b* of the link 8 to the hinge element 4 in the manner most apparent from FIG. 5.

Figure 2:
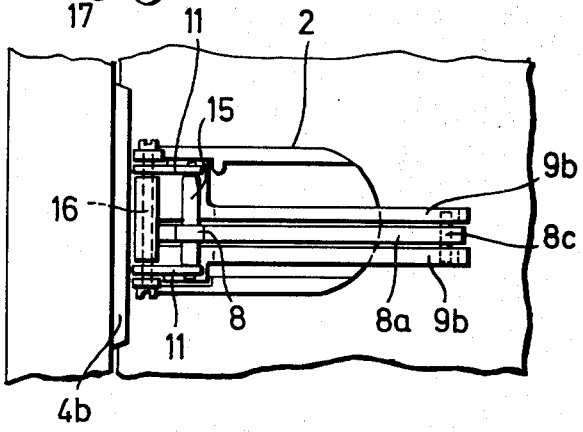
FIG. 2 is a fragmentary underside view of the hinge of FIG. 1 looking from bottom to top, and illustrates details of the links, pivots and slot and pin connections.

A second portion of the link mechanism 7 includes a pair of identical links or arms 11, 13 between which is disposed the link 8 in the manner most apparent from FIG. 2. The pivot pin 12 connects the arms 11 at one end thereof to the projection 9*d* whereas a mid portion of the arms 11 are connected by a pivot pin 15 to the link 8, in the manner best illustrated in FIGS. 2 and 3. A pivot pin 16 passes through elongated slots 18 of the arms or links 13 (FIGS. 2 and 3) and the pin or pins 16 are also pivotally connected to the left most end of the link 11, as viewed in FIG. 3. Thus the links 11, 13 are articulately mounted relative to each other by the sliding movement of the pivot pin or pins 16 within the slots 17. A pivot pin 14 pivotally connects the links or arms, 13, 13 to projections (unnumbered) of the flange 4*b* of the hinge element 4.

Figure 3:
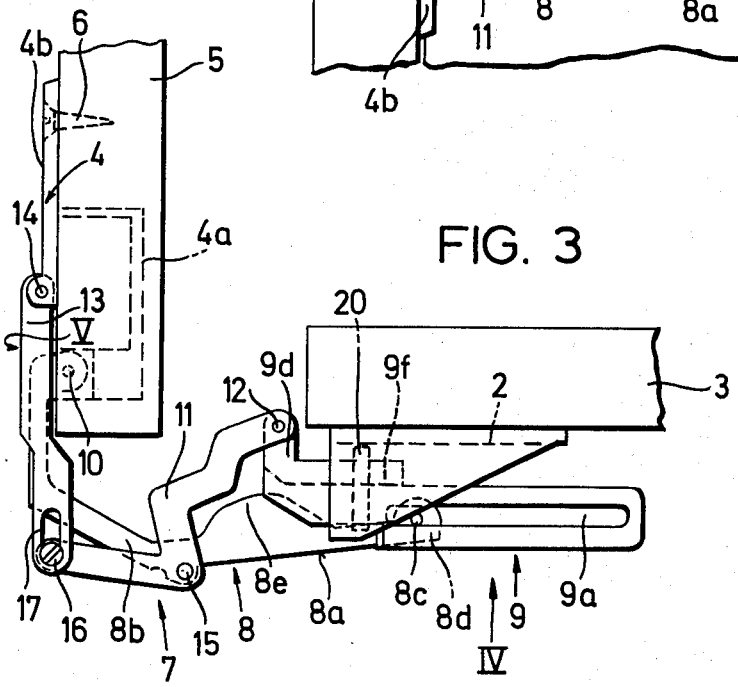
FIG. 3 is a fragmentary view similar to FIG. 2, and illustrates the hinge in its open position.
Figure 4:
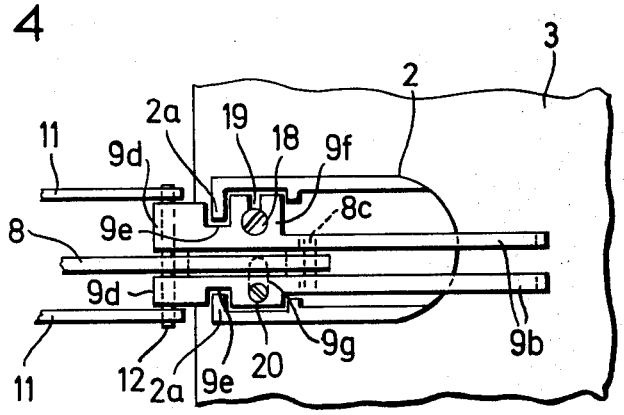
FIG. 4 is a fragmentary view taken generally along line IV of FIG. 3, and illustrates details for adjusting a mounting plate of one of the hinge elements relative to a base plate thereof.
Figure 5:
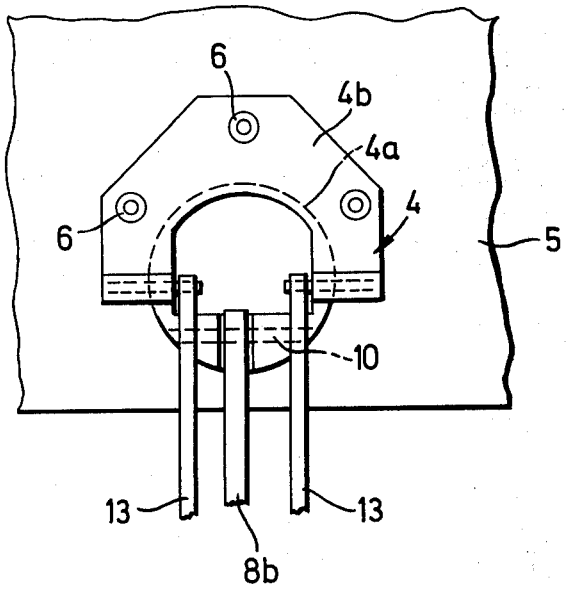
FIG. 5 is a fragmentary view taken generally along line V of FIG. 3, and illustrates details of the connection of hinge links to a hinge element secured to a door.
Figure 6:
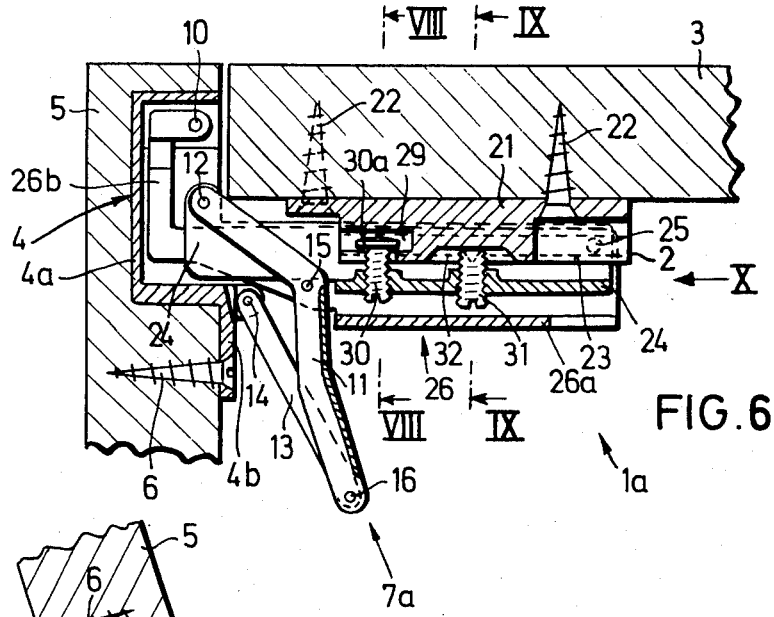
FIG. 6 is a fragmentary cross-sectional view of another hinge constructed in accordance with this invention, and apart from elements common to those of the hinge of FIGS. 1 through 5 additionally illustrates a different slidable connection between the hinge elements and means for both locking carrier and base plates to each other and varying the angular inclination therebetween.

The operation of the hinge 1 is believed readily apparent from a comparison of FIGS. 1 and 3. However, it is to be noted that in keeping with this invention the slots 9*a* of the bars 9 may be curvilinear instead of linear preferably with a convex curvilinear path with the curve portion facing the frame 3 to achieve a modified opening action by a change in the sliding motion of the pin 8*c* relative to the thus differently contoured slots 9*a*, 9*a*.

Reference is now made to a hinge 1*a* of FIGS. 6 through 11 of the drawings includes like reference numerals to indicate structure corresponding to that of the hinge 1 of FIGS. 1 through 5. However, the hinge 1*a* differs somewhat from the hinge 1 including the construction of the hinge element 2 and portions of a link mechanism 7*a*.

Figure 11:
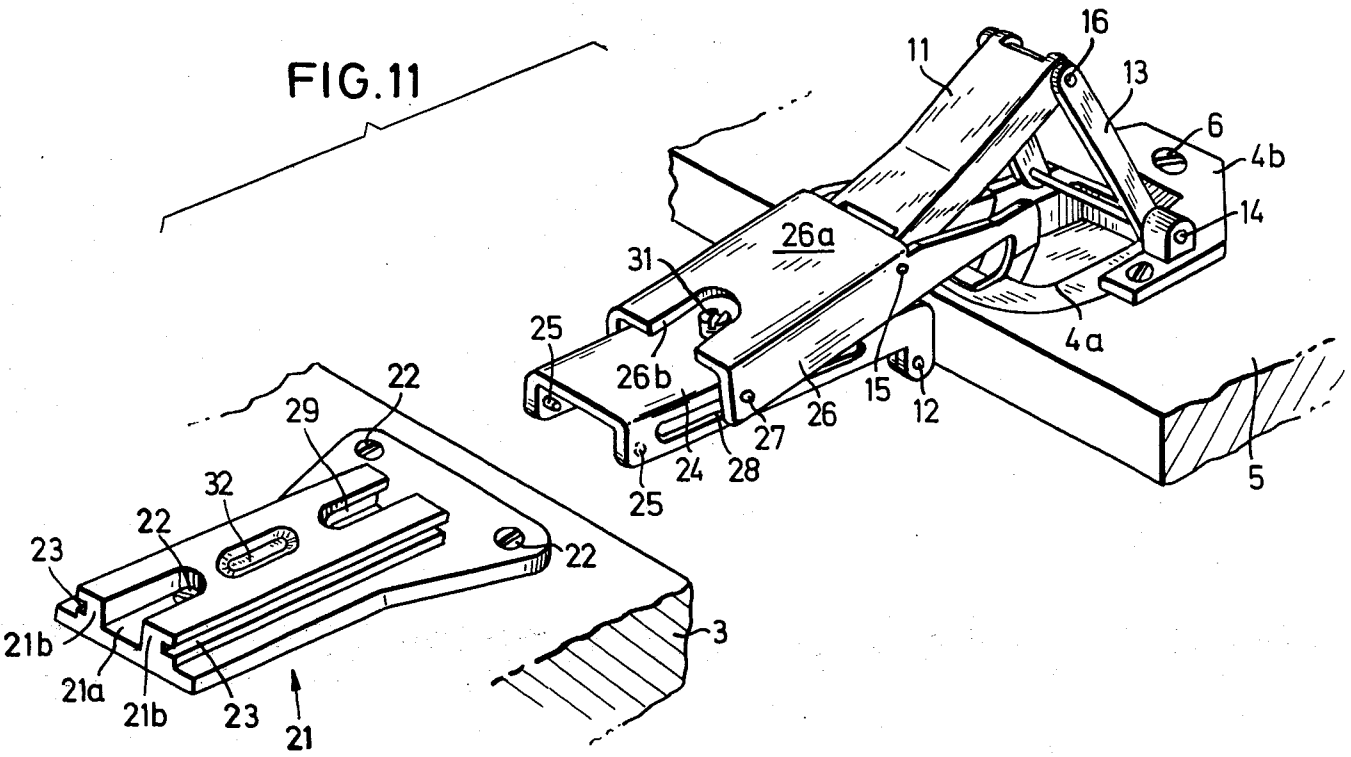
FIG. 11 is a perspective view of the hinge with the base plate separated from the carrier plate.

The hinge element 2 of the hinge 1*a* includes a base plate 21 (FIGS. 6, 7 and 11) having apertures (unnumbered) therein through which pass screws 22 for securing the base plate 21 to the frame 3. A pair of upstanding walls 21*b*, 21*b* have formed therein oppositely opening parallel slots or grooves 23, 23, and at opposite ends of the base plate there are formed oppositely directed slots 21*a*, 29 and a longitudinal recess 32 therebetween (FIG. 11).

Figure 7:
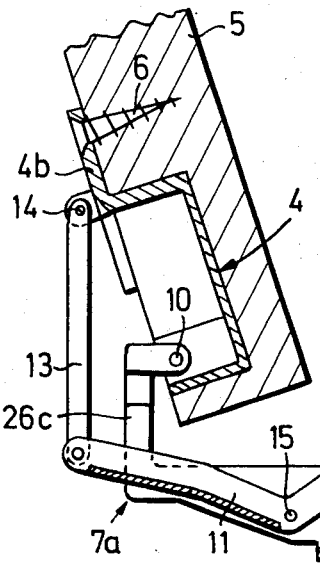
FIG. 7 is a fragmentary sectional view of the hinge of FIG. 6, and illustrates the hinge in its open position.
Figure 8:
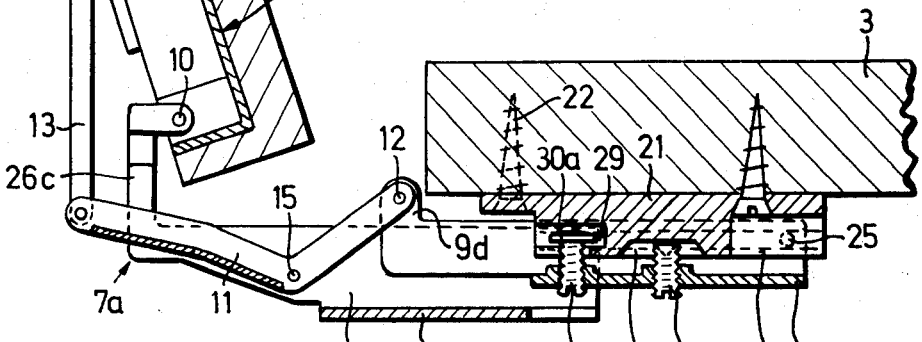
FIG. 8 is a sectional view taken generally along line VIII—VIII of FIG. 6, and illustrates the manner in which a carrier plate is locked to a base plate which is in turn secured to a frame.
Figure 8:
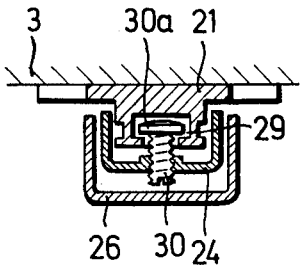
Figure 9:
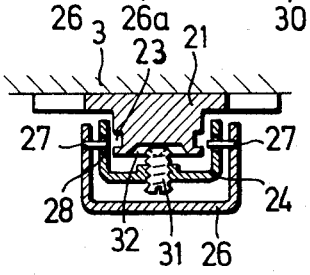
FIG. 9 is a sectional view taken generally along line IX—IX of FIG. 6, and illustrates a set screw for varying the inclination between the base plate and the carrier plate, along with a slot and pin connection between a U-shaped cross-sectioned arm and the carrier plate.
Figure 10:
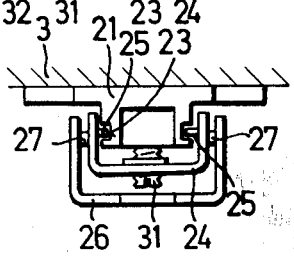
FIG. 10 is an end view taken along line X of FIG. 6, and illustrates further details of the base and carrier plates and an end of an associated link.

A carrier plate 24 of a generally U-shaped configuration, as viewed in transverse cross-section, carries at one end opposing pins 25, 25 (FIGS. 10 and 11) which are received in the grooves 23, 23 of the base plate 21. The pins 25, 25 are carried by parallel lateral or side walls (unnumbered) each of which includes an elongated linear slot 28 with each slot 28 receiving an associated pin 27 (FIGS. 9 and 11) carried by lateral sides or walls (unnumbered) of a link or arm 26 having a bight portion 26*a* slotted at 26*b* and terminating at an end remote from the slot 26*b* in a pair of parallel arms 26*c* (FIG. 7) each of which is pivotally connected by the pivot pins 10 to the hinge element 4 (FIG. 7). The pivot pin 15 additionally connects the link 26 to the link 11 and the latter includes a bight portion (unnumbered) and a pair of arms or legs which are pivoted at 12 to a projection 9*d* of the base plate 21. The slot 26*b* is formed in the bight portion 26*a* of the link 26 to provide access to a screw 31 (FIGS. 7 and 11) threaded into the bight portion (unnumbered) of the carrier plate 24 which bottoms against the recess 32. By adjusting the screw 31 the angular relationship between the base plate 21 and the carrier plate 24 can be altered and since the carrier plate 24 includes the slots 28 this adjustment in turn provides for lateral adjustment of the door 5 through the link mechanism 7*a*. In order to lock the carrier plate 24 relative to the base plate 21 a screw 30 having a head 30*a* received in the slot 29 is also threaded in a threaded bore (unnumbered) of the bight portion of the carrier plate 24, in the manner best shown in FIG. 7. The longitudinal slot 32 also permits relative sliding motion between the base plate 21 and the carrier plate 24 to provide for and aft adjustment of the door 5 relative to the frame 3. Both for angular and relative sliding adjustment between the plates 21, 24 the screw 30 maintains these elements in the precise desired position.

While preferred forms and arrangements of parts have been shown in illustrating the invention, it is to be clearly understood that various changes in detail and arrangement of parts may be made without departing from the spirit and scope of this disclosure.

I claim:

1. A hinge comprising a pair of relatively movable hinge elements, a first link having opposite ends, first pivot means for pivotally connecting a first end of said first link to one of said hinge elements, means for slidably connecting a second end of said first link to the other of said hinge elements, a second link having opposite ends, second pivot means for pivotally connecting a first end of said second link to said one hinge element, third pivot means for pivotally connecting a second end of said link to the other of said hinge elements, said second link having first and second link arms, means articulately connecting said first and second link arms to each other, fourth pivot means between said articulate connecting means and said third pivot means for pivotally connecting one of said link arms to said first link between said first pivot means and said slidable connecting means, said articulately connecting means includes an elongated slot in one of said first and second link arms, fifth pivot means carried by the other of said first and second link arms, and said fifth pivot means being disposed in said slot for relative sliding motion during relative movement of said hinge elements.

2. The hinge as defined in claim 1 wherein said slot is in said second link arm and said fifth pivot means is carried by said first link arm.

3. A hinge comprising a pair of relatively movable hinge elements, a first link having opposite ends, first pivot means for pivotally connecting a first end of said first link to one of said hinge elements, means for slidably connecting a second end of said first link to the other of said hinge elements, a second link having opposite ends, second pivot means for pivotally connecting a first end of said second link to said one hinge element, third pivot means for pivotally connecting a second end of said second link to the other of said hinge elements, said second link having first and second link arms, means articulately connecting said first and second link arms to each other, fourth pivot means between said articulate connecting means and said third pivot means for pivotally connecting one of said link arms to said first link between said first pivot means and said slidable connecting means, said slidable connecting means including a pair of spaced plates, and said first link being in sliding sandwiched relationship between said pair of plates.

4. The hinge as defined in claim 3 wherein said first link includes a laterally projecting portion which is in sliding sandwiched relationship between said pair of plates.

5. The hinge as defined in claim 4 wherein said laterally projecting portion is disposed in its sandwiched relationship between said pair of plates in all relative positions of said movable hinge elements.

6. The hinge as defined in claim 3 wherein said pair of plates define a space corresponding to the thickness of said first link thereby precluding canting of said first link during relative sliding motion of said first link relative to said pair of plates.

7. The hinge as defined in claim 6 wherein said first link includes a laterally projecting portion which is in sliding sandwiched relationship between said pair of plates.

8. The hinge as defined in claim 7 wherein said laterally projecting portion is disposed in its sandwiched relationship between said pair of plates in all relative positions of said movable hinge elements.

9. A hinge comprising a pair of hinge elements, a first link having opposite ends, first pivot means for pivotally connecting a first end of said first link to one of said hinge elements, means for slidably connecting a second end of said first link to the other of said hinge elements, a second link having opposite ends, second pivot means for pivotally connecting a first end of said second link to said one hinge element, third pivot means for pivotally connecting a second end of said second link to the other of said hinge elements, said second link having first and second link arms, means articulately connecting said first and second link arms to each other, fourth pivot means between said articulate connecting means and said third pivot means for pivotally connecting one of said link arms to said first link between said first pivot means and said slidable connecting means, said other hinge element includes means defining a guide slot, said slidable connecting means is defined in part by a base member, said base member including a portion disposed in said guide slot whereby said base member can be slid relative to said other hinge element, means for effecting sliding movement of said base member relative to said other hinge element, and means for locking said base member relative to said other hinge element at selected positions of relative adjustment therebetween as determined by said sliding movement effecting means.

10. The hinge as defined in claim 9 wherein said sliding movement effecting means is a screw.

11. The hinge as defined in claim 9 wherein said locking means is a screw.

12. The hinge as defined in claim 9 wherein said sliding movement effecting means is a screw threadedly carried by said base member portion and bottoming against said other hinge element.

13. The hinge as defined in claim 12 wherein said locking means is a screw.

14. A hinge comprising a pair of relatively movable hinge elements, a first link having opposite ends, first pivot means for pivotally connecting a first end of said first link to one of said hinge elements, means for slidably connecting a second end of said first link to the other of said hinge elements, a second link having opposite ends, second pivot means for pivotally connecting a fist end of said second link to said one hinge element, third pivot means for pivotally connecting a second end of said second link to the other of said hinge elements, said second link having first and second link arms, means articulately connecting said first and second link arms to each other, fourth pivot means between said articulate connecting means and said third pivot means for pivotally connecting one of said link arms to said first link between said first pivot means and said slidable connecting means, the other of said hinge elements including first and second members, said first member being adapted for attachment to a base, said first member having a generally T-shaped slot as viewed in transverse cross section, said T-shaped slot being defined by a slot leg intersecting a slot arm, said T-shaped slot opening through an end face of said first member, said third pivot means connecting said second end of said second link to said second member, said second member having a threaded bore, a screw threaded into said threaded bore, said screw having a head and a shank, said shank passing through said slot leg, and said head being disposed in said slot arm whereby said screw can be rotated to both prevent relative movement between said first and second members or permit disassembly thereof by the passage of said head outwardly of said T-shaped slot through said end face.

15. The hinge as defined in claim 14 including screw means for locking said first and second members together to prevent relative movement therebetween.

16. The hinge as defined in claim 15 wherein said screw means is threaded in a threaded bore of said second member whereby upon disassembly of said first and second members said screw and screw means are carried by said second member.

17. The hinge as defined in claim 16 including a longitudinal recess in said first member, and said screw means bottoms in said recess.

18. A hinge comprising a pair of relatively movable hinge elements, a first link having opposite ends, first pivot means for pivotably connecting a first end of said first link to one of said hinge elements, means for slidably connecting a second end of said first link to the other of said hinge elements, a second link having opposite ends, second pivot means for pivotally connecting a first end of said second link to said one hinge element, third pivot means for pivotally connecting a second end of said second link to the other of said hinge elements, said second link having first and second link arms, means articulately connecting said first and second link arms to each other, fourth pivot means between said articulate connecting means and said third pivot means for pivotally connecting one of said link arms to said first link between said first pivot means and said slidable connecting means, and said first and second link arms being each of a generally U-shaped transverse cross-section.

* * * * *